United States Patent [19]

Hoos

[11] 4,141,234

[45] Feb. 27, 1979

[54] DEAD BOLT GUARD

[75] Inventor: Paul R. Hoos, South Gate, Calif.

[73] Assignee: Norris Industries, Inc., South Gate, Calif.

[21] Appl. No.: 882,341

[22] Filed: Mar. 1, 1978

[51] Int. Cl.[2] ..... E05B 9/08

[52] U.S. Cl. ..... 70/350; 70/462; 292/244

[58] Field of Search ..... 70/350, 351, 352, 362; 292/244, 346, 337

[56] References Cited

U.S. PATENT DOCUMENTS

| | | | |
|---|---|---|---|
| 2,327,070 | 8/1943 | Schlage | 70/450 |
| 2,655,030 | 10/1953 | Schlage | 70/450 |
| 3,036,850 | 5/1962 | Schmid | 292/244 |
| 3,673,605 | 6/1972 | Allenbaugh | 292/346 |

*Primary Examiner*—Robert L. Wolfe

[57] ABSTRACT

A guard mount structure for a dead bolt installation on a door has a preassembled condition wherein a dead bolt subassembly consisting of a housing and a dead bolt shaft is attached to a sheet metal guard. The sheet metal guard has opposite plates for attachment to opposite faces of the door and an end plate overlying the end face of the door, the housing of the dead bolt subassembly being attached to the inside face of the end plate.

5 Claims, 3 Drawing Figures

Fig. 1.
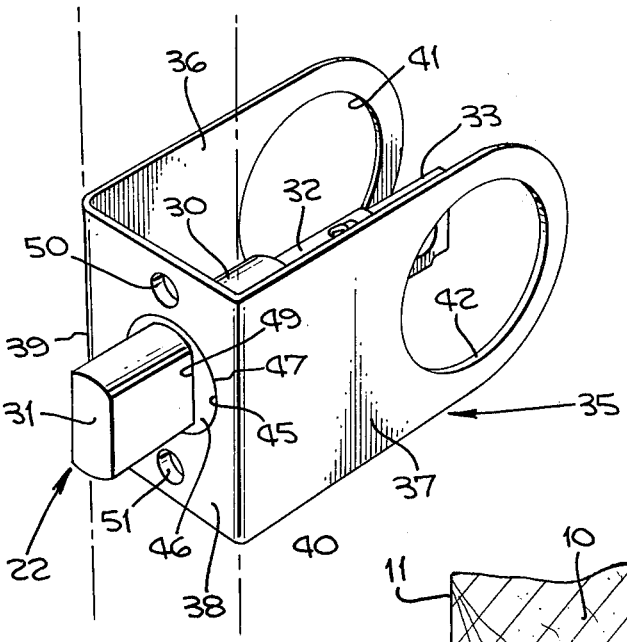
Fig. 3.
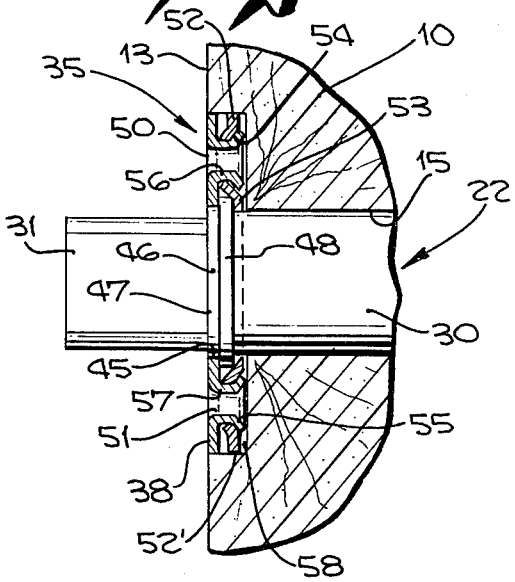
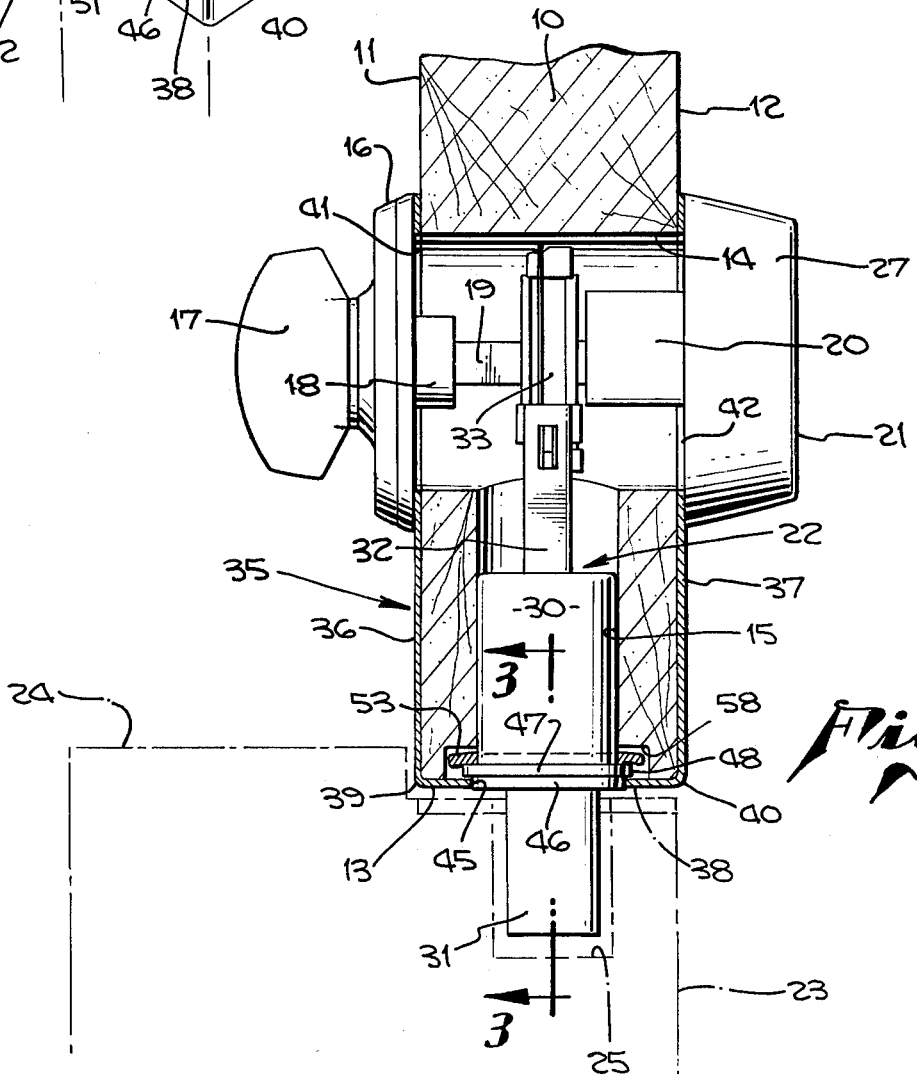
Fig. 2.

DEAD BOLT GUARD

The trend of improvements currently in door locks is to improve the locks from the point of view of security. In doing this the industry has recognized that in all probability as a commercial item, no lock is absolute assurance against forcible entry of some kind. Building structures and modern tools are such that an unauthorized person, given an adequate amount of time and opportunity, can forcibly open a door, even though the door is provided with a dead bolt lock or door lock of comparable kind, which, as a commercial item, has been made as secure as consumer demand warrants.

The mode of operation of unauthorized persons to a large extent is one of forcing the door as quickly as possible by whatever means may be necessary to enable the unauthorized person to make the entry and then leave the premises as quickly as possible before the entry has been detected. Because of this anticipated mode of operation, it becomes quite worthwhile for the owner of the premises to provide a deterrent which, even though it may not be absolute assurance against forcible entry, makes the entry sufficiently time-consuming to discourage most unauthorized persons.

It is further true that there are a great many installations of such things as dead bolts already in place, insufficiently guarded according to current demands. It is, therefore, in the interest of the building owner to renovate such existing door locks wherever it can be done in order to make unauthorized entry more difficult and time-consuming.

It is, therefore, among the objects of the invention to provide a new and improved dead bolt guard which is applicable over a substantially conventional dead bolt assembly which covers a sufficient amount of the door surface adjacent the dead bolt to provide a deterrent for forcing entry by dislodgement of the dead bolt mechanism.

Another object of the invention is to provide a new and improved dead bolt guard which is simple in its construction and sufficiently versatile so that it can be applied with equal effectiveness to doors already equipped with such a dead bolt as well as on new construction, and for either right or left hand mountings.

Still another object of the invention is to provide a new and improved dead bolt guard which is capable of being preassembled with the dead bolt mechanism itself so that the entire unit can be easily and effectively installed as such on a door.

Still further among the objects of the invention is to provide a new and improved dead bolt guard which is capable of encompassing and protecting virtually all portions of the dead bolt mechanism and the surrounding portions of the door, thereby to serve as an improved deterrent for unauthorized entry.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 1 is a front perspective view of the dead bolt guard assembled with a dead bolt assembly.

FIG. 2 shows the guard mounted with a lock set on a typical door section.

FIG. 3 is a fragmentary sectional view on the line 3—3 of FIG. 2.

In an embodiment of the invention chosen for the purpose of illustration a door 10 is shown in end section providing an outside face 11, an inside face 12, and an end face 13. The door is provided with a conventional cross bore 14 extending between the inside and outside faces 11 and 12, and an edge bore 15 extending inwardly from the edge face 13 into the cross bore 14.

A typical installation for a dead bolt mechanism is one which, by way of example, consists of an inside trim 16 on which is mounted a thumb turn 17 provided with a conventional shaft 18. The shaft is in non-rotating slidable engagement with a tail piece 19 manipulated by an appropriate key actuated mechanism 20 through an outside trim 21 in which is an appropriate key way (not shown). The trim is incorporated in a guard ring having a beveled wall 27 to discourage the unauthorized application of a pipe wrench to dislodge the key actuated mechanism.

The tail piece 19 is adapted to cooperate with a dead bolt subassembly indicated generally by the reference character 22.

A typical installation is suggested by showing the door in cooperation with a frame 23 and stop 24, there being a dead bolt recess 25 in the frame behind a latch plate 26, each of the last mentioned parts being shown in phantom view in FIG. 2.

The mechanism of the dead bolt subassembly 22 is substantially conventional, but for purpose of illustration may be referred to as comprising a housing 30 from which extends a bolt head 31. At the opposite end of the housing is a housing extension 32 provided with an appropriate conventional roll back assembly at the location 33 with which the tail piece 19 is engaged.

To adequately guard the dead bolt subassembly and its operating mechanism, there is provided a cage 35 which consists of an inside plate 36, an outside plate 37 and an end plate 38. The end plate joins the inside plate at a corner 39 where adjacent edges join, there being also a corner 40 where the outside edge of the end plate 38 joins the corresponding edge of the outside plate 37. One of the plates may be tilted 3° to match the conventional bevel of the door.

In the inside plate is an opening 41 which is in axial alignment with a corresponding opening 42 in the outside plate 37. The opening 41 provides for communication between the thumb turn 17 and the interior, the opening 42 providing a space for mounting the key actuated mechanism 20. As shown in the drawing, only the end face of the door is recessed for reception of the end plate 38. The inside and outside plates 36 and 37 actually overlie the respective faces of the door.

In the end plate is a hole 45 in which is located a circular central portion 46 of a ferrule 47, there being a perimetrical flange 48 for the ferrule lying behind the end plate 38. In the middle of the central portion 46 is a hole 49 for accommodation of the bolt head 31. The hole 45 is expressly made circular to accommodate the circular central portion 46 so that the ferrule together with the operating mechanism of the latch bolt can be rotated 180° about the longitudinal axis, in order to properly accommodate the dead bolt to either a right-hand or left-hand installation.

Additionally, in the end plate is a pair of mounting holes 50 and 51, the mounting holes being in alignment with each other on respective upper and lower sides of the bolt head 31. On a back plate 53 and on respective upper and lower sides of the housing 31 are wings 52 and 52', the upper wing being located behind the mounting hole 50 and the lower wing being located behind the mounting hole 51. Additionally, in the wing 52 is a countersunk hole 54, there being a corresponding countersunk hole 55 in the wing 52'. The material of the end plate is deformed to provide, in effect, a sleeve 56 rivetted with respect to the countersunk holes 54 and 55 so that the sleeves are flared and ironed into engagement with the countersunk walls of the holes, thereby to fasten the corresponding wing 52 to the end plate 38. A similar sleeve 57 serves the same purpose with respect to the wing 52' and the end plate.

Attached as shown and described, the dead bolt subassembly 22 is secured to the cage 35 so that they together are handled as an assembly.

It is of some further interest that the material of the respective wings 52 and 52', where they have been deformed to provide their respective countersunk holes 54 and 55, are displaced in a direction toward the adjacent inside face of the end plate 38, the deformed portions actually spacing the wings a short distance from the end plate. As a consequence of this arrangement, the end face 13 of the door 10 will need to be chiselled out more deeply in the area of the wings as shown in FIG. 3, thereby to form a deeper recess 58 to accommodate the wings.

When the installation is to be made, the customary cross bore 14 and edge bore 15 are made in the door. The cage may then be preliminarily applied in order to locate edges of the necessary recess, thereafter to be chiselled for reception of the end plate. This having been prepared as noted, the cage is then reapplied and at the same time the dead bolt subassembly 22 is projected into the edge bore 15. Appropriate screws (now shown) are then driven in conventional fashion through the mounting holes 50 and 51 to fasten the cage in place. After the outside trim and guard ring 21 have been applied and secured in position by appropriate bolts and sleeves (not shown) from the inside trim 16, inwardly disposed faces of the trims are drawn into snug engagement with the respective faces of the inside and outside plates. The dead bolt subassembly is guarded from tampering by the interposition of the material of the cage, which covers the wood material of the door throughout the area surrounding the installation.

By having the metal plates anchored by the trims in a position covering the relatively thin wood section between the edge bore 15 and the adjacent face of the door 10, the wood cannot be readily splintered to dislodge the dead bolt, which would othersied be possible, absent the protection of the plate.

Having described the invention, what is claimed as new in support of Letters Patent is as follows:

1. A guard mount structure for a dead bolt installation on a door wherein a dead bolt assembly has a bolt head and an operating mechanism, and a housing for accommodation of the bolt head with an end edge adjacent said head, and wherein the door has inside, outside and end faces, said structure comprising a cage having an outside plate for the outside face, an inside plate for the inside face and an end plate for the end face, said end plate having opposite edges in common with respective adjacent edges of the side plates, said end plate having a circular hole for the dead bolt head and a plurality of mounting holes, wings on said housing underlying the inside face of said end plate, a ferrule having a central portion in said circular hole and a perimetrical flange located between the end plate and an end edge of said housing, mounting holes in said wings opposite respective mounting holes in said end plate making in each instance a matching pair of holes, wall portions of said wings being directed to a position of engagement with said end plate, said pairs of mounting holes providing means for attachment together of said cage and said dead bolt assembly.

2. A guard mount structure as in claim 1 wherein a portion of said end plate comprises a fastening sleeve in each pair of mounting holes, the holes in the wings having a countersunk form and respective ends of the sleeve being flared into the corresponding countersunk form whereby to hold the housing and the cage in preassembled relationship.

3. A guard mount structure as in claim 2 wherein a portion of each wing around the countersunk form of the respective hole is displaced in a direction toward the end plate and engages said end plate whereby to space the wing from the adjacent face of the end plate.

4. A guard mount assembly as in claim 2 wherein said ferrule and latch bolt head are rotatable relative to the end plate and the housing.

5. A guard mount structure as in claim 1 wherein there are axially aligned openings in the respective side plates in alignment with the operating mechanism in preassembled relationship.

* * * * *